US012188253B1

(12) United States Patent
Liu

(10) Patent No.: US 12,188,253 B1
(45) Date of Patent: Jan. 7, 2025

(54) PARAPET

(71) Applicant: Shenzhen Teng'an Business Co., Ltd., Guangdong (CN)

(72) Inventor: Guidong Liu, Guangdong (CN)

( * ) Notice: Subject to any disclaimer, the term of this patent is extended or adjusted under 35 U.S.C. 154(b) by 0 days.

(21) Appl. No.: 18/667,544

(22) Filed: May 17, 2024

(30) Foreign Application Priority Data

Jun. 14, 2023 (CN) ..... 202321522557.2

(51) Int. Cl.
*E04H 17/22* (2006.01)
*E04H 12/22* (2006.01)

(52) U.S. Cl.
CPC ..... *E04H 17/22* (2013.01); *E04H 12/2215* (2013.01); *E04H 12/2238* (2013.01)

(58) Field of Classification Search
CPC .. E04H 17/22; E04H 12/2215; E04H 12/2238
USPC ..... 256/65.01, 65.14, 65.04; 248/156, 530, 248/188.5, 125.8; 52/156, 157, 160, 52/582.1, 586.1, 585.1
See application file for complete search history.

(56) References Cited

U.S. PATENT DOCUMENTS 427,815 A * 5/1890 Wolf ..... E04H 12/2215 52/165
4,266,757 A * 5/1981 Kirkwood ..... E04H 17/21 256/49
5,134,815 A * 8/1992 Pickett ..... E04H 17/1404 52/592.4
5,536,111 A * 7/1996 Doernemann ..... E02B 3/06 405/21
5,927,694 A * 7/1999 Montepiano ..... E04H 17/143 256/22
8,407,956 B2 * 4/2013 Smith ..... E02D 29/02 52/855

FOREIGN PATENT DOCUMENTS

CN 111287551 A * 6/2020
CN 111350405 A * 6/2020 ..... E02B 15/06
FR 2977615 A3 * 1/2013 ..... E04H 17/1404
WO WO-2020151026 A1 * 7/2020 ..... E01F 9/615

* cited by examiner

*Primary Examiner* — Brent W Herring

(57) ABSTRACT

A parapet, including a parapet body and a support rod. The parapet body defines a mounting groove passing through a bottom of the parapet body. The support rod extends in an up-down direction. The support rod is detachably fixedly connected in the mounting groove. The support rod includes a socket portion, and the socket portion extends out of a bottom opening of the mounting groove for insertion into a ground.

9 Claims, 8 Drawing Sheets

PARAPET

CROSS REFERENCE

The present disclosure claims priority of Chinese Patent Application No. 2023215225572 filed on Jun. 14, 2023, the entire contents of which are hereby incorporated by reference in their entirety.

TECHNICAL FIELD

The present disclosure relates to the technical field of parapets, and more specifically to a parapet.

BACKGROUND

The development of society, especially the progress of science and technology, greatly promotes the rapid development of social productivity. People are enjoying the happiness that comes from an increasingly abundant material life, while putting forward more and more high requirements for the living and working environments.

A garden fence, i.e., a parapet, plays a certain role in protecting and beautifying the role of adding color to the garden, such as flower beds, which is widely used in life. The design effect of its unique and innovative styling design is attractive, bringing a fresh and natural flavor of the aesthetic enjoyment. The garden fence in the existing technology is heavier and larger, such that it is not easy for the user to move or place, which increases the difficulty of moving. In addition, in the process of using the garden fence, the user cannot assemble quickly, which brings inconvenience to the user.

The foregoing is only intended to assist in understanding the technical solution of the present disclosure, and does not mean that the foregoing is recognized as prior art.

SUMMARY OF THE DISCLOSURE

In view of the above problems, the present disclosure proposes a parapet, aiming at solving the technical problem of improving the convenience of disassembling and assembling the parapet.

In order to realize the above purpose, the proposed parapet includes: a parapet body, defining a mounting groove passing through a bottom of the parapet body; and a support rod, extending in an up-down direction; wherein the support rod is detachably fixedly connected in the mounting groove; the support rod includes a socket portion, and the socket portion extends out of a bottom opening of the mounting groove for insertion into a ground.

In some embodiments, the mounting groove further passes through a top of the parapet body, and a top end of the support rod extends out of a top opening of the mounting groove to form a snap-in structure; the parapet body is arranged with a mating structure, and the snap-in structure is capable of being snap-fit with the mating structure to limit an upward movement of the support rod relative to the parapet body.

In some embodiments, the snap-in structure includes a connection portion, an elastic arm portion, and a support portion; the connection portion extends in a front-back direction, and an end of the connection portion is connected to the top end of the support rod; the elastic arm portion extends in the up-down direction, and a top end of the elastic arm portion is connected to an end of the connection portion away from the support rod; the support portion is connected to a lower end of the elastic arm portion and extends towards the support rod;

the mating structure includes a mating protrusion protruding from the parapet body, and an end of the support portion near the support rod is snapped to the mating protrusion upwardly.

In some embodiments, the support portion is inclined downwardly from an end near the elastic arm portion toward an end near the support rod; and/or the snap-in structure further includes a guide portion, the guide portion extending from top to bottom at an incline in a direction away from the support rod; a top end of the guide portion is connected to an end of the support portion near the support rod; in condition of the snap-in structure being mated with the mating structure from top to bottom, the mating protrusion slides along the guide portion until being snapped with the support portion.

In some embodiments, the socket portion includes at least two socket sections, the at least two socket sections being arranged along a length direction of the support rod; a limiting step is formed between each adjacent two of the at least two socket sections, and a limiting surface of the limiting step is facing upwards.

In some embodiments, a width of each socket section decreases from top to bottom; and/or, a tip is formed at a bottom end of the socket portion.

In some embodiments, along a length direction of the parapet body, a side of the parapet body defines a connection groove, and the other side of the parapet body is arranged with a connection post, each of the connection groove and the connection post extending in the up-down direction; an upper end or a lower end of the connection groove passes through the parapet body to define an assembly inlet; the connection groove is configured to mate with another connection post of another parapet body through the assembly inlet, and the connection post is configured to mate with another connection groove of another parapet body through another assembly inlet.

In some embodiments, the assembly inlet is disposed at a lower end of the connection groove, and the connection groove is arranged with a limiting portion opposite the assembly inlet at an upper end of the connection groove; the limiting portion is configured to limit the another connection post.

In some embodiments, the parapet body includes a connection rod and two parapet panels; the mounting groove is defined in the connection rod, and the two parapet panels are connected to opposite sides of the connection rod.

In some embodiments, a size of the connection rod in a front-back direction is greater than a thickness of each parapet panel; and/or a reinforcement bar is arranged protruding from a surface of each parapet panel.

In the technical solution of the present disclosure, the support rod may be detachably mated with the mounting groove of the parapet body, and it is possible to realize the switching of the support rod and the parapet body between the separated state and the assembled state, so as to facilitate the user's carrying and assembling the parapet, thereby improving the convenience of the use of the parapet. In addition, the support rod is mated with the mounting groove, which may improve the mating area of the support rod and the parapet body, thereby improving the stability of the mating.

BRIEF DESCRIPTION OF THE DRAWINGS

To illustrate the technical solutions of the embodiments of the present disclosure more clearly, the accompanying drawings of the embodiments will be briefly described below, and it will be apparent that the accompanying drawings in the following description relate only to some embodiments of the present disclosure and other drawings may be obtained from these drawings by those skilled in the art without creative labor.

REFERENCE NUMERALS

Figure 1:
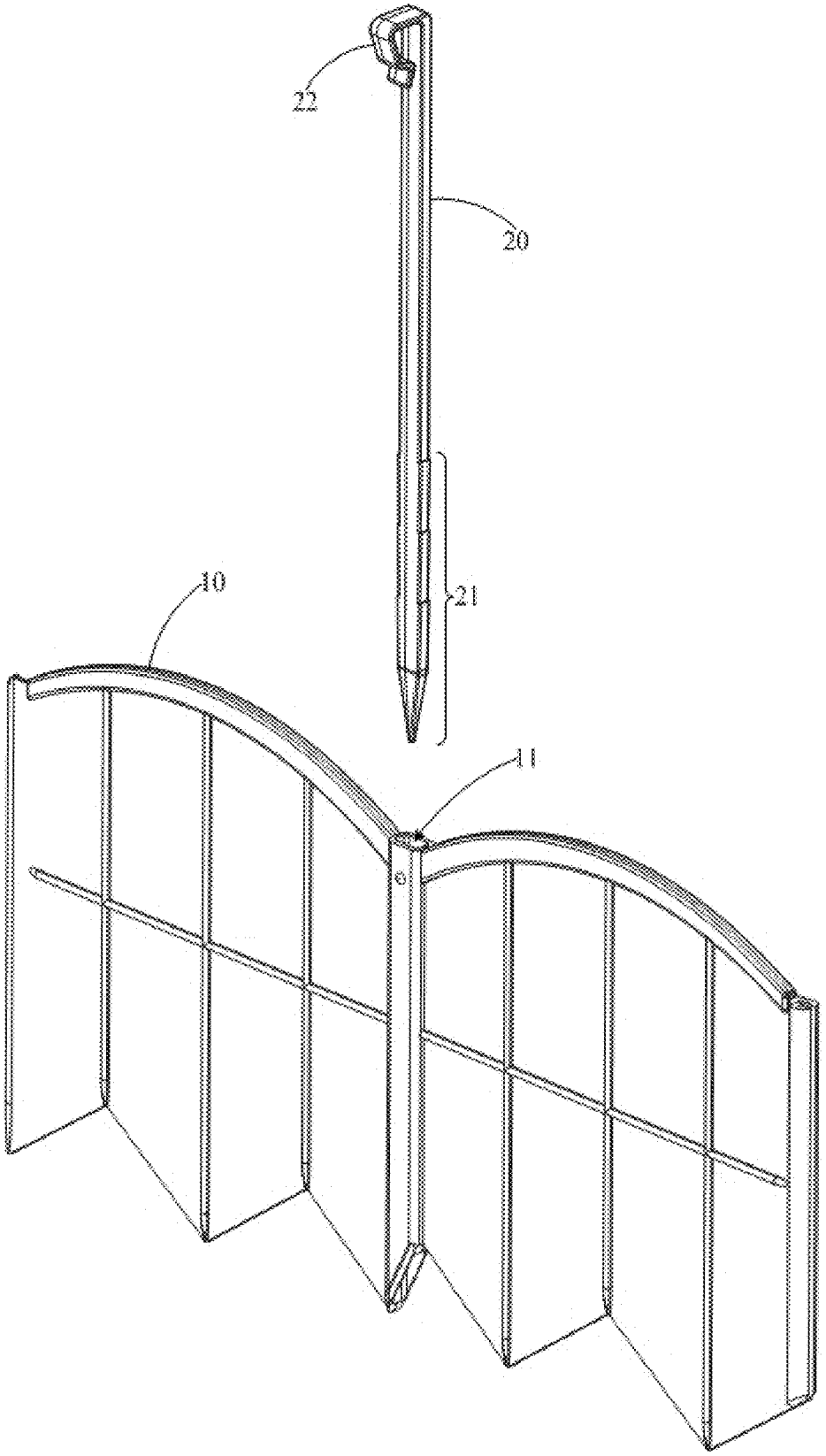
FIG. 1 is a disassembled schematic view of a parapet according to some embodiments of the present disclosure.

| No. | Name | No. | Name | No. | Name |
|---|---|---|---|---|---|
| 10 | Parapet body | 11 | Mounting groove | 20 | Support rod |
| 21 | Socket portion | 22 | Snap-in structure | 12 | Mating structure |
| 221 | Connection portion | 222 | Elastic arm portion | 223 | Support portion |
| 224 | Guide portion | 121 | Mating protrusion | 23 | Socket section |
| 24 | Limiting step | 13 | Connection groove | 14 | Connection post |
| 131 | Assembly inlet | 132 | Limiting portion | 15 | Connection rod |
| 16 | Parapet panel | 161 | Reinforcement bar | | |

The realization of the purpose, functional features, and advantages of the present disclosure will be further described in conjunction with the embodiments and with reference to the accompanying drawings.

DETAILED DESCRIPTION

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure and not all of the embodiments. Based on the embodiments in the present disclosure, all other embodiments obtained by those skilled in the art without creative labor fall within the scope of the present disclosure. In addition, the technical solutions between various embodiments can be combined with each other, but it must be based on the fact that those skilled in the art is able to realize it. When the combination of the technical solutions appears to be contradictory or unattainable, it should be considered that the combination of such technical solutions does not exist, and is not included in the scope claimed by the present disclosure.

It should be noted that when the embodiments of the present disclosure involve directional indications (such as up, down, left, right, forward, back . . . ), the directional indications are only intended to explain a relative positional relationship, a movement, etc. between the various components in a particular attitude. When the particular attitude changes, the directional indications are also changed accordingly.

In addition, when the embodiments of the present disclosure contain descriptions involving "first", "second", etc., the descriptions of "first", "second", etc. are intended only for descriptive purposes, and are not to be construed as indicating or implying their relative importance or implicitly specifying the number of the indicated technical features. That is, a feature defined as "first" or "second" may include at least one such feature either explicitly or implicitly. In addition, the meaning of "and/or" in the whole text is to include three concurrent solutions. For example, "A and/or B" includes an A solution, a B solution, and a solution in which A and B are satisfied at the same time.

The development of society, especially the progress of science and technology, greatly promotes the rapid development of social productivity. People are enjoying the happiness that comes from an increasingly abundant material life, while putting forward more and more high requirements for the living and working environments. A garden fence, i.e., a parapet, plays a certain role in protecting and beautifying the role of adding color to the garden, such as flower beds, which is widely used in life. The design effect of its unique and innovative styling design is attractive, bringing a fresh and natural flavor of the aesthetic enjoyment. The garden fence in the existing technology is heavier and larger, such that it is not easy for the user to move or place, which increases the difficulty of moving. In addition, in the process of using the garden fence, the user cannot assemble quickly, which brings inconvenience to the user.

The present disclosure proposes a parapet, aiming to solve the technical problem of improving the convenience of disassembling and assembling the parapet.

Figure 2:
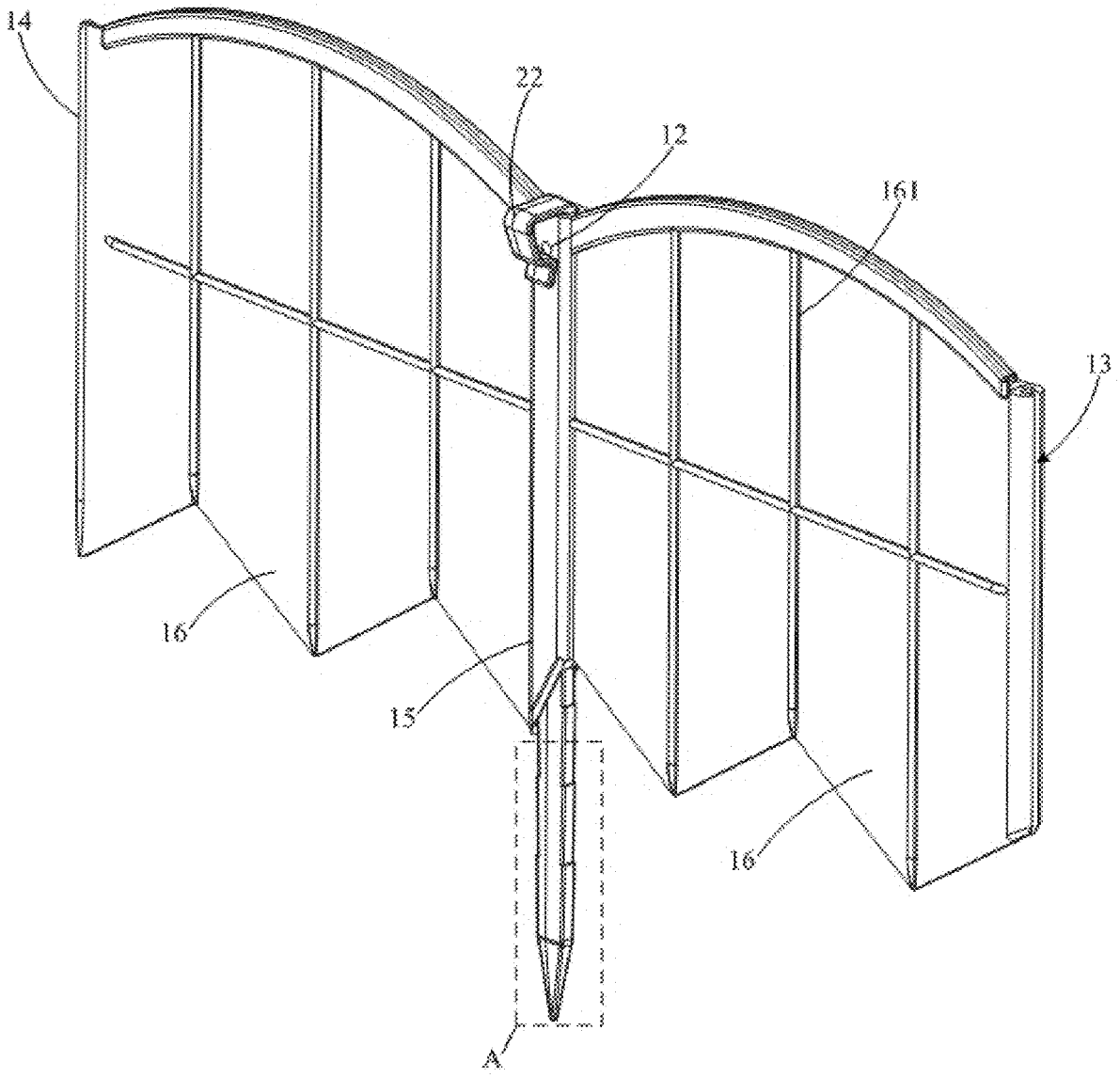
FIG. 2 is an assembled schematic view of a parapet according to some embodiments of the present disclosure.

In the embodiments of the present disclosure, referring to FIG. 1 and FIG. 2, FIG. 1 is a disassembled schematic view of a parapet according to some embodiments of the present disclosure; FIG. 2 is an assembled schematic view of a parapet according to some embodiments of the present disclosure.

The parapet includes a parapet body 10 and a support rod 20; the parapet body 10 defines a mounting groove 11 passing through a bottom of the parapet body 10; the support rod 20 extends in an up-down direction, and the support rod 20 is detachably fixedly connected in the mounting groove 11; the support rod 20 includes a socket portion 21, and the socket portion 21 extends out of a bottom opening of the mounting groove 11 for insertion into the ground.

In the embodiments, the parapet body 10 and the support rod 20 can be switched between a separated state and an assembled state. When the parapet is required to be handled or transported, the support rod 20 may be withdrawn from the mounting groove 11 to realize the separation of the parapet body 10 and the support rod 20, thereby facilitating the packing or loading of the parapet body 10 and the support rod 20, so as to reduce the difficulty of handling or transporting the parapet. When the parapet is required to be assembled, the support rod 20 may be mounted into the mounting groove 11, and the socket portion 21 extending out of the mounting groove 11 may be inserted into the ground, such that the support rod 20 can fixedly support the parapet body 10 on the ground to realize the protection and decorative effect of the parapet body 10.

In the technical solution of the present disclosure, the support rod 20 may be detachably mated with the mounting groove 11 of the parapet body 10, and it is possible to realize the switching of the support rod 20 and the parapet body 10 between the separated state and the assembled state, so as to facilitate the user's carrying and assembling the parapet, thereby improving the convenience of the use of the parapet. In addition, the support rod 20 is mated with the mounting groove 11, which may improve the mating area of the support rod 20 and the parapet body 10 compared to other mounting methods, thereby improving the stability of the mating, and may further ensure the centering of the support rod 20 on the parapet body 10, thereby making the insertion and connection of the parapet more effective.

Specifically, the mounting groove 11 may further pass through a top of the parapet body 10, i.e., the mounting groove 11 is arranged passing through the parapet body 10 in the up-down direction. In this way, during a mounting process of the support rod 20, the support rod 20 may be inserted into the mounting groove 11 from top to bottom, and then the socket portion 21 may be made to extend out of the bottom opening of the mounting groove 11. During a detaching process of the support rod 20, the support rod 20 may be directly withdrawn from the mounting groove 11 upwardly, thereby simplifying the process of removing the support rod 20 so as to improve the convenience of removing. A top end of the support rod 20 may extend out of the top of the mounting groove 11 or may be received in the mounting groove 11, without limitation herein.

Exemplarily, as shown in FIGS. 1 and 2, the mounting groove 11 extends through the top of the parapet body 10, and the top end of the support rod 20 extends out of a top opening of the mounting groove 11 and forms a snap-in structure 22; the parapet body 10 is arranged with a mating structure 12, and the snap-in structure 22 is snap-fit with the mating structure 12 to limit an upward movement of the support rod 20 relative to the parapet body 10.

The snap-fit structure 22 is disposed on an outside of the top opening of the mounting groove 11. When the support rod 20 is fit into place with the mounting groove 11, the snap-fit structure 22 is snap-fit with the mating structure 12 to achieve a relative fixation of the support rod 20 with the parapet body 10 in the up-down direction, thereby improving the mounting stability of the support rod 20 with the parapet body 10. It can be understood that since the snap-fit structure 22 and the mating structure 12 are snap-fit together, when the support rod 20 is required to be disassembled, the snap-fit structure 22 may be elastically deformed by applying a predetermined disassembly force, such that the support rod 20 can be disassembled without the use of tools, thereby improving the disassembling and assembling convenience between the parapet body 10 and the support rod 20.

Figure 4:
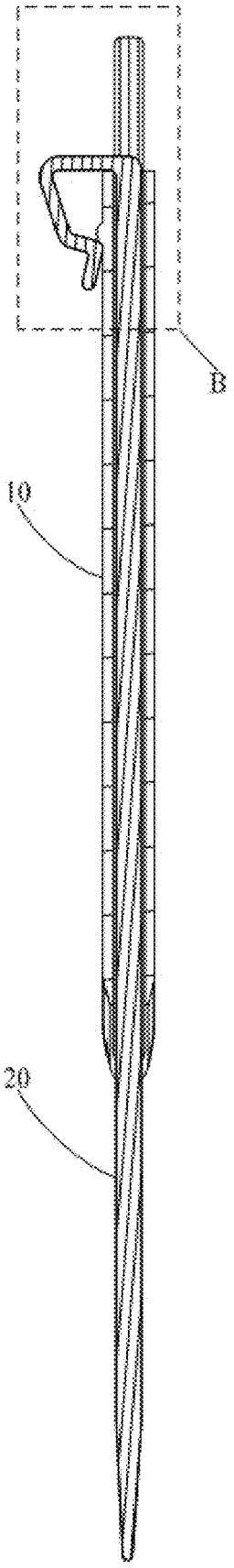
FIG. 4 is a cross-sectional schematic view of a parapet according to some embodiments of the present disclosure.
Figure 5:
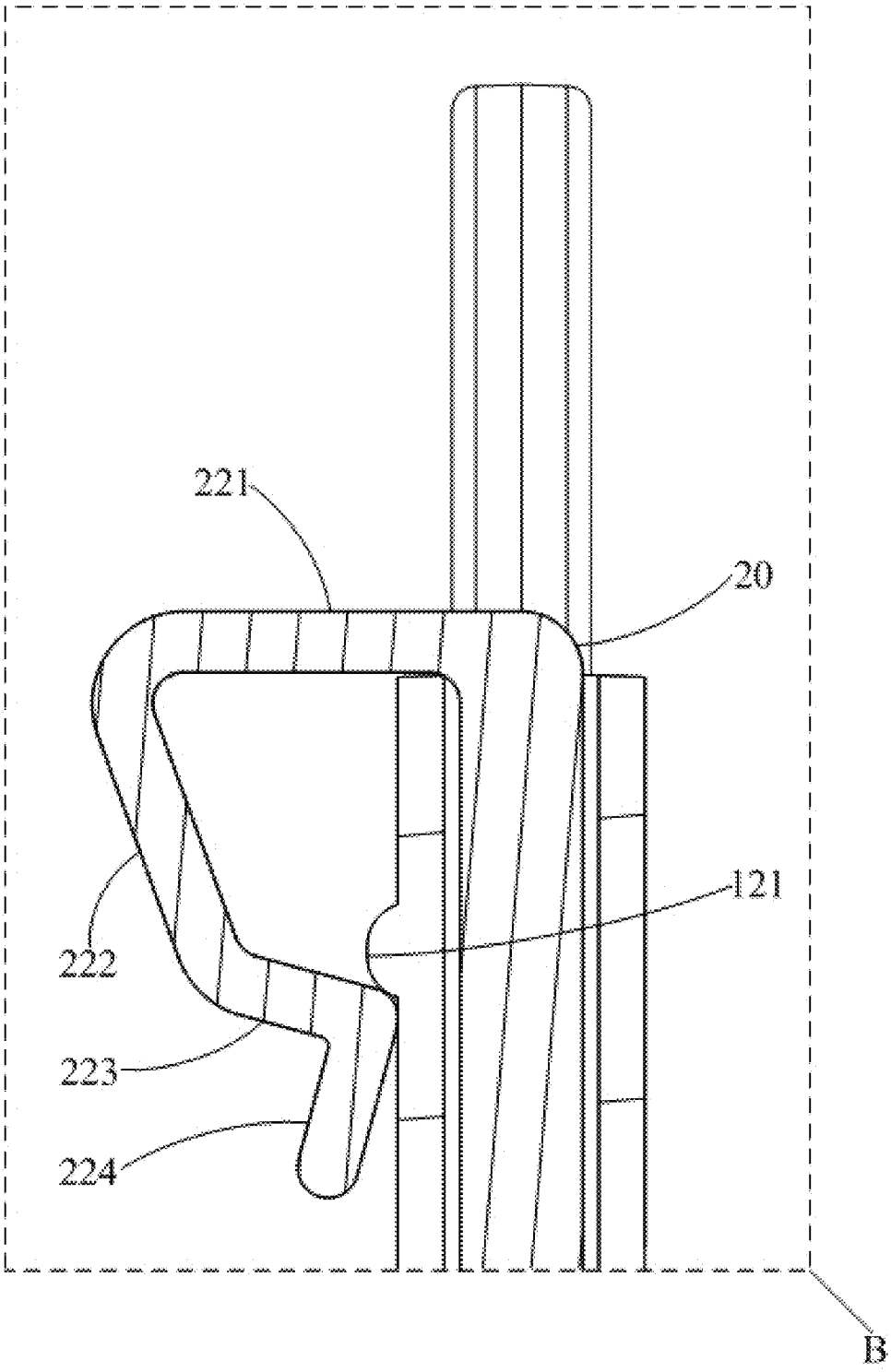
FIG. 5 is a partially enlarged view at area B in FIG. 4.

Specifically, as shown in FIGS. 4 and 5, FIG. 4 is a cross-sectional schematic view of a parapet according to some embodiments of the present disclosure, and FIG. 5 is a partially enlarged view at area B in FIG. 4.

The snap-in structure 22 includes a connection portion 221, an elastic arm portion 222, and a support portion 223; where the connection portion 221 extends in a front-back direction and an end of the connection portion 221 is connected to the top end of the support rod 20; the elastic arm portion 222 extends in the up-down direction, and a top end of the elastic arm portion 222 is connected to an end of the connection portion 221 away from the support rod 20; the support portion 223 is connected to a lower end of the elastic arm portion 222 and extends towards the support rod 20; the mating structure 12 includes a mating protrusion 121 protruding from the parapet body 10, where an end of the support portion 223 near the support rod 20 is snapped to the mating protrusion 121 upwardly.

In the embodiments, the front-back direction is the thickness direction of the parapet, the mating protrusion 121 may protrude from a front surface or a rear surface of the parapet body 10, and the mating protrusion 121 is near the top opening of the mounting groove 11. After the support rod 20 is mated in place with the mounting groove 11, the connection portion 221 abuts against an edge of the top opening of the mounting groove 11 to limit the support rod 20 from continuing to move downwardly. The connection portion 221, the elastic arm portion 222, and the support portion 223 together form a "⊏"-shaped handle structure and enclose to define a handle space. When the snap-in structure 22 is mated with the mating structure 12, the mating protrusion 121 is disposed in the handle space and abuts against the support portion 223 downwardly, such that the mating protrusion 121 can limit an upward movement of the support portion 223, i.e., limiting the support rod 20 from being upwardly disengaged from the mounting groove 11.

When it is necessary to release a catching state of the catching structure 22 and the mating structure 12, the user may grasp the elastic arm portion 222 and break it in a direction away from the mating protrusion 121, and the elastic arm portion 222 has a certain elastic deformation ability, such that it may elastically deform under the action of the user's application of force, so as to drive the support portion 223 away from the mating protrusion 121, and such that the support portion 223 may be moved away from a position under the mating protrusion 121 to release the restriction of the support portion 223 by the mating protrusion 121. As a result, after grasping the elastic arm portion 222 and breaking it, the user may continue to lift the snap-in structure 22 upwardly, thereby withdrawing the entire support rod 20 from the mounting groove 11 to realize the disassembling of the support rod 20. In other words, the detaching process of the support rod 20 can be completed by one hand breaking the elastic arm portion 222 before lifting the support rod 20, which simplifies the detaching process of the support rod 20 and further improves the detaching convenience of the support rod 20.

In practice, the support portion 223 is inclined downwardly from an end near the elastic arm portion 222 toward an end near the support rod 20, i.e., the end of the support portion 223 abutting against the mating protrusion 121 is lower than the end of the support portion 223 far away from the mating protrusion 121. In this way, when the user grasps the elastic arm portion 222 and applies a force upwardly directly, the inclined support portion 223 can be squeezed in the direction away from the mating protrusion 121, and the elastic arm portion 222 can be squeezed and deformed to disengage the support portion 223 from the mating protrusion 121. As a result, the user does not need to break the elastic arm portion 222 after grasping it, but only needs to lift the support rod 20 upward with a predetermined pulling force to disengage the snap-in structure 22 from the mating structure 12, which further improves the case of disassembly of the support rod 20.

Exemplarily, as shown in FIG. 5, the snap-in structure 22 further includes a guide portion 224, the guide portion 224 extending from top to bottom at an incline in a direction away from the support rod 20; a top end of the guide portion 224 is connected to an end of the support portion 223 near the support rod 20; when the snap-in structure 22 is mated with the mating structure 12 from top to bottom, the mating protrusion 121 slides along the guide portion 224 until it is snapped with the support portion 223.

In the process of the mating of the snap-fit structure 22 with the mating protrusion 121, as the snap-fit structure 22 moves downwardly, the guide portion 224 is first pressed against the mating protrusion 121, the mating protrusion 121 slides along the guide portion 224 and squeezes the guide portion 224 outwardly, and the squeezing pressure on the guide portion 224 is transmitted to the elastic arm portion 222 through the support portion 223 to elastically deform the elastic arm portion 222, which may reduce the resistance generated before the support portion 223 is mated with the mating protrusion 121, thereby simplifying the mating process between the snap-fit structure 22 and the mating structure 12 and improving the assembly convenience.

The socket portion 21 may be in the form of a continuously extending rod or may be continuously connected in the form of sections.

Figure 3:
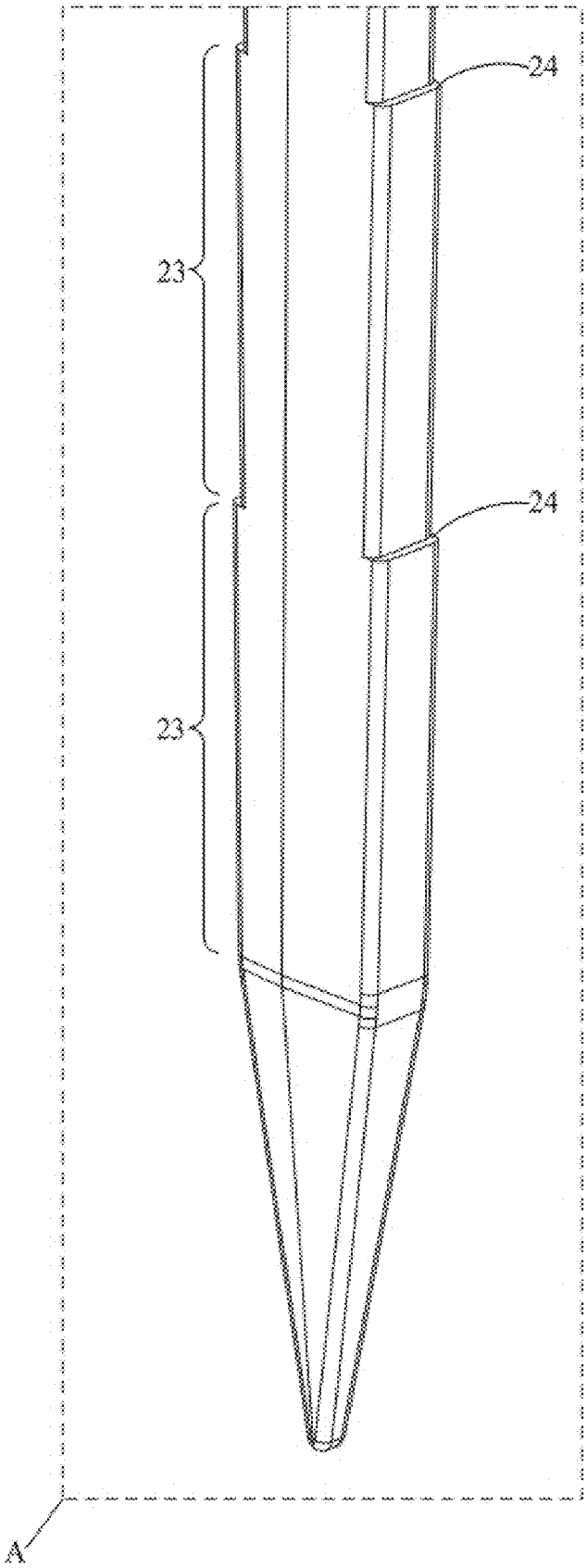
FIG. 3 is a partially enlarged view at area A in FIG. 2.

Exemplarily, as shown in FIG. 3, FIG. 3 is a partially enlarged view at area A in FIG. 2. The socket portion 21 includes at least two socket sections 23, the at least two socket sections 23 being arranged along a length direction of the support rod 20; a limiting step 24 is formed between each adjacent two socket sections 23, and a limiting surface of the limiting step 24 is facing upwards. After the socket portion 21 is inserted into the ground, the limiting step 24 may be covered by soil, such that the soil may create resistance to the socket section 23 below the limiting step 24, thereby increasing the resistance when the socket portion 21 is pulled out of the ground, which increases the stability of insertion of the socket portion 21 and thus increases the stability of mounting of the parapet. In addition, the limiting step 24 may further be used as an indication mark to indicate the current insertion depth of the socket portion 21 into the ground, so as to facilitate the user to adjust a preset insertion depth.

Specifically, as shown in FIG. 3, the width of each socket section 23 decreases from top to bottom, such that the resistance to the insertion of each socket section 23 into the ground can be reduced to improve the insertion convenience of the socket portion 21. In practice, as shown in FIG. 3, a tip is formed at a bottom end of the socket portion 21 to facilitate the increase of pressure to break through the soil just before the beginning of the insertion into the ground, thereby further improving the convenience of insertion.

The overall length size of the parapet is required to be adapted to the size of an enclosed site. In order to facilitate transportation, the length size of the parapet body 10 is required to be reasonably controlled. In this way, when the required overall length size of the parapet is large, two or more parapet bodies 10 can be spliced consecutively to satisfy both the transportation needs and the actual use needs of the parapet.

The splicing between two adjacent parapet bodies 10 may be snap-fit or connected by fasteners, which is not limited herein. Exemplarily, as shown in FIG. 6 and FIG. 7, FIG. 6 is a structural schematic view of a parapet according to other embodiments of the present disclosure, and FIG. 7 is a partially enlarged view at area C in FIG. 6.

Along the length direction, a side of the parapet body 10 defines a connection groove 13, and the other side of the parapet body 10 is arranged with a connection post 14, each of the connection groove 13 and the connection post 14 extending in the up-down direction; an upper end or a lower end of the connection groove 13 passes through the parapet body 10 to define an assembly inlet 131; the connection groove 13 is configured to mate with the connection post 14 of another parapet body 10 through the assembly inlet 131, and the connection post 14 is configured to mate with the connection groove 13 of another parapet body 10 through the assembly inlet 131.

The length direction of the parapet body 10 can be understood as a left-right direction with respect to the up-down direction and the front-back direction (thickness direction). The connection post 14 may be arranged on the left side of the parapet body 10 and the connection groove 13 on the right side of the parapet body 10. In this way, when it is necessary to splice two adjacent parapet bodies 10, it is only necessary to assemble the connection post 14 of each parapet body 10 with the connection groove 13 of an adjacent parapet body 10 or assemble the connection groove 13 of each parapet body 10 with the connection post 14 of an adjacent parapet body 10. It should be noted that the width of the connection post 14 should be less than the width of the connection groove 13, so as to prevent the connection post 14 from detaching from the connection groove 13 along the left-right direction. When it is necessary to dismantle the two spliced parapet bodies 10, it is only necessary to take out the connection post 14 from the assembly inlet 131, thereby reducing the dismantling process of two adjacent parapet panels 16 bodies to enhance the dismantling convenience. Further, each parapet body 10 may have the same structure to facilitate centralized production and processing.

Figure 6:
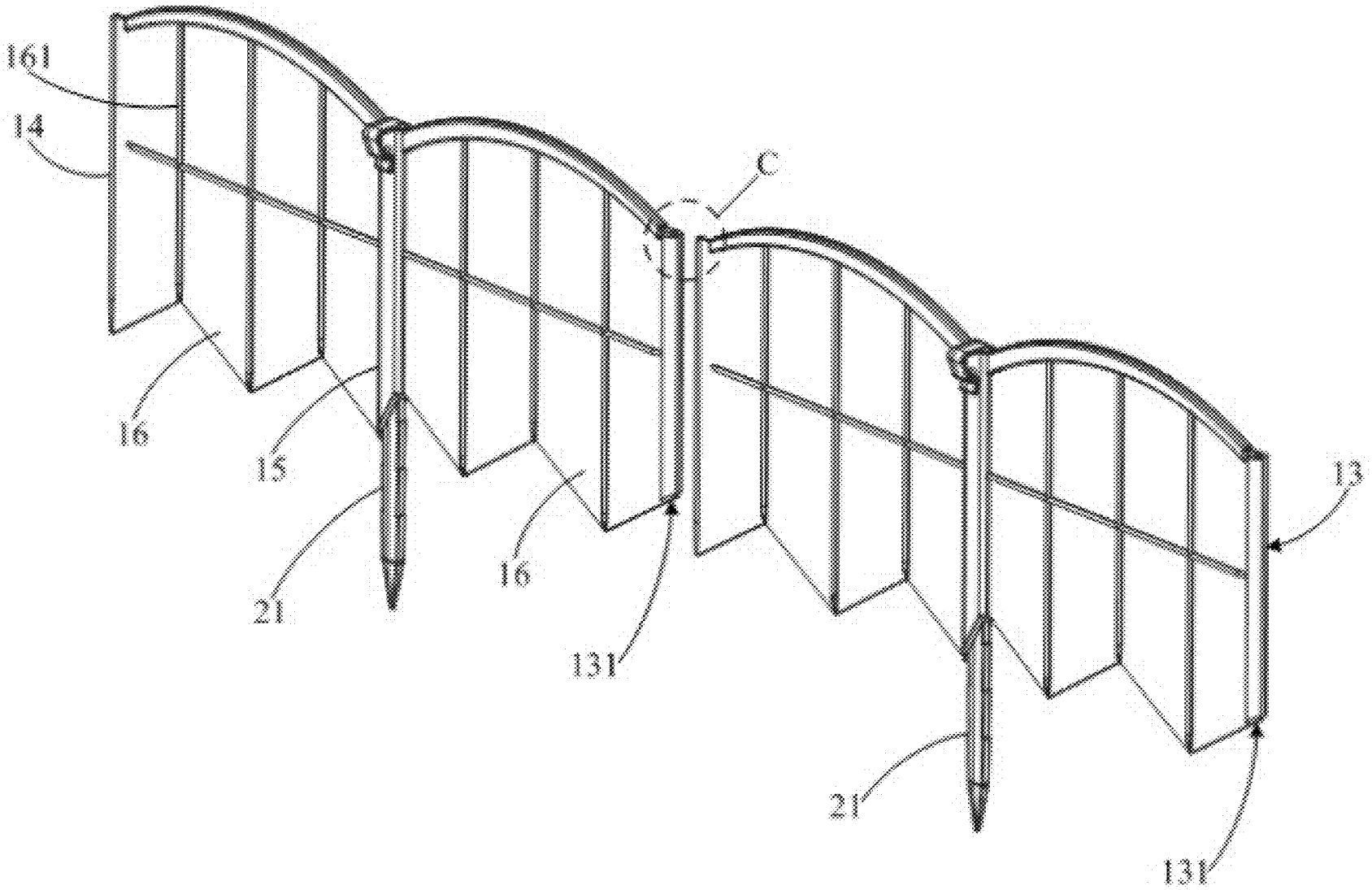
FIG. 6 is a structural schematic view of a parapet according to other embodiments of the present disclosure.
Figure 7:
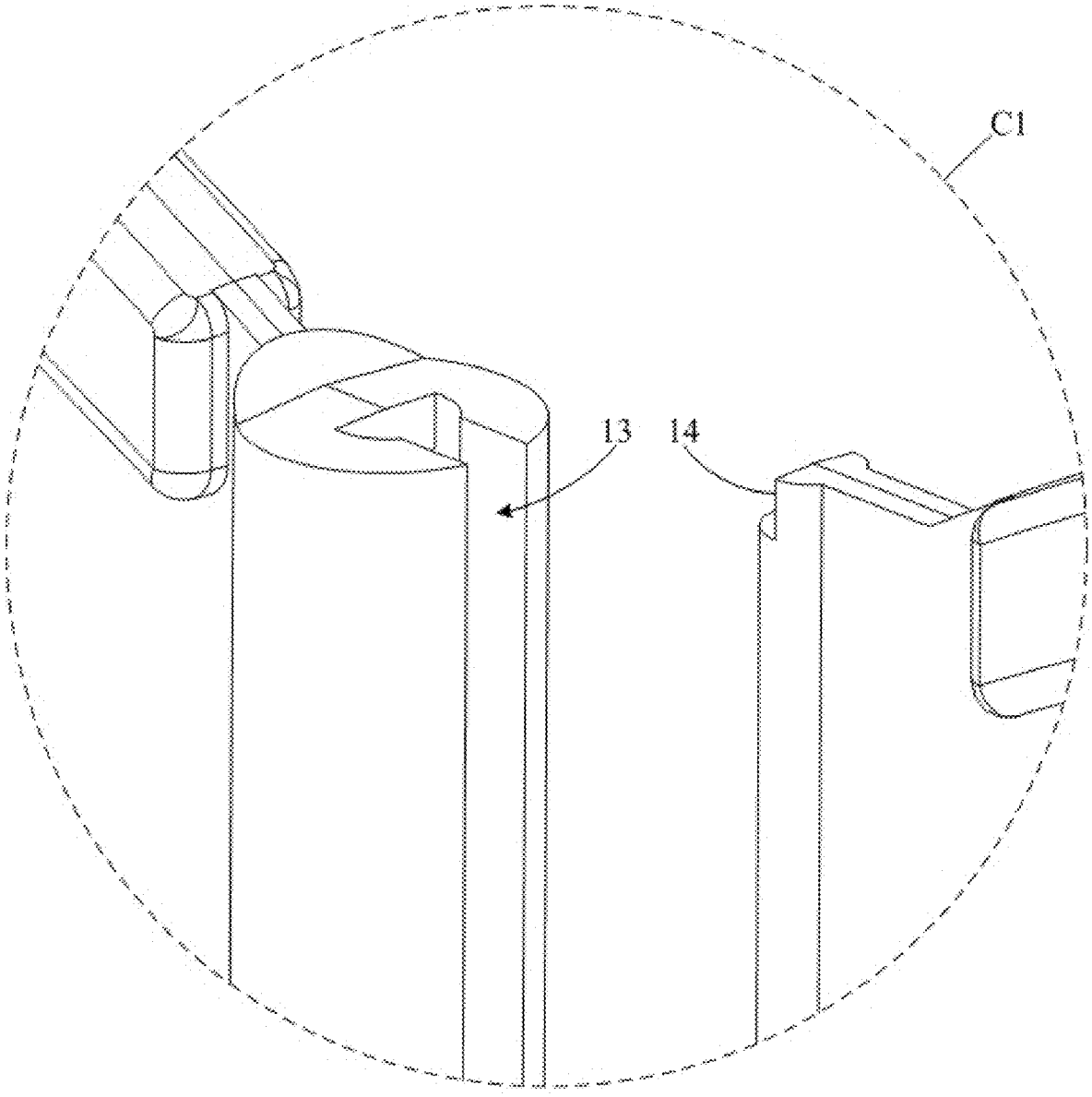
FIG. 7 is a partially enlarged view at area C in FIG. 6.
Figure 8:
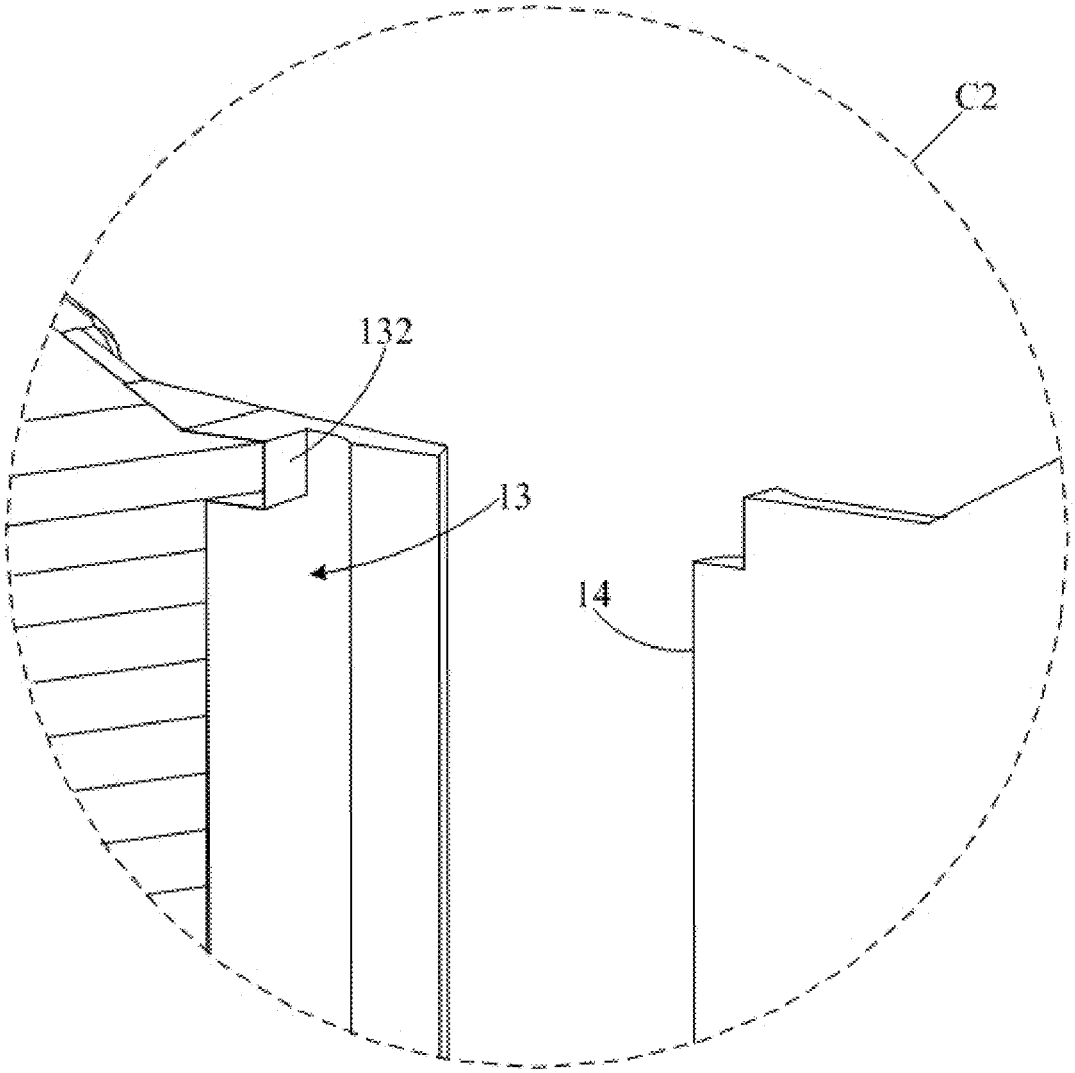
FIG. 8 is a cross-section of a partially enlarged view at area C in FIG. 6.

Specifically, as shown in FIG. 8, FIG. 8 is a cross-section of a partially enlarged view at area C in FIG. 6. The assembly inlet 131 is disposed at a lower end of the connection groove 13, and the connection groove 13 is arranged with a limiting portion 132 opposite the assembly inlet 131 at an upper end of the connection groove 13; the limiting portion 132 is configured to limit the connection post 14. The limiting portion 132 may limit the connection post 14 of the adjacent parapet body 10 from disengaging from the connection groove 13 upwardly, so as to prevent that, in the process of the use of the parapet, a parapet body 10 from being easily detached from an adjacent parapet body 10 when subjected to an upward-facing force, thereby improving the structural stability of the parapet in a state of use.

The parapet body 10 may be in the form of a continuously extending plate or in the form of a grill, without limitation herein. Exemplarily, as shown in FIG. 6, the parapet body 10 includes a connection rod 15 and two parapet panels 16; the mounting groove 11 is defined in the connection rod 15, and the two parapet panels 16 are connected to opposite sides of the connection rod 15. Connecting the two parapet panels 16 through the connection rod 15 may improve the connection strength of the two parapet panels 16 and avoid defining the mounting groove 11 directly on the parapet panels 16, thereby maintaining the structural strength of the parapet panels 16 themselves. In combination with the above embodiments providing the mating structure 12, the mating structure 12 may be arranged on a circumferential wall of the connection rod 15 to avoid direct force on the parapet panels 16, which may improve the overall structural stability of the parapet body 10.

Specifically, as shown in FIG. 6, a reinforcement bar 161 is arranged protruding from a surface of each parapet panel 16 to improve the structural strength of the parapet panel 16 and prevent the parapet panel 16 from being easily deformed or damaged when subjected to force. The number of the reinforcement bars 161 may be one, two, or more; the multiple reinforcement bars 161 may be crisscrossed on the surface of the parapet panel 16 to further improve the structural strength of the parapet panel 16.

In practical application, the size of the connection rod 15 in the front-back direction is greater than the thickness of the parapet panel 16 to improve the structural strength of the connection rod 15, thereby improving the stability of the mating between the connection rod 15 and the support rod 20.

In the technical solution of the present disclosure, the support rod 20 may be detachably mated with the mounting groove 11 of the parapet body 10, and it is possible to realize the switching of the support rod 20 and the parapet body 10 between the separated state and the assembled state, so as to facilitate the user's carrying and assembling the parapet, thereby improving the convenience of the use of the parapet. In addition, the support rod 20 is mated with the mounting groove 11, which may improve the mating area of the support rod 20 and the parapet body 10, thereby improving the stability of the mating.

Finally, it should be noted that the above embodiments are only intended to illustrate the technical solutions of the present disclosure, and not to limit them. Although the present disclosure has been described in detail with reference to the foregoing embodiments, those skilled in the art should understand that it is still possible to make modifications to the technical solutions recorded in the foregoing embodiments, or to make equivalent replacements for some of the technical features therein. These modifications or substitutions do not cause the essence of the technical solutions to depart from the spirit and scope of the technical solutions of the embodiments in the present disclosure.

What is claimed is:

1. A parapet, comprising:

a parapet body, defining a mounting groove passing through a bottom of the parapet body; and a support rod, extending in an up-down direction; wherein the support rod is detachably fixedly connected in the mounting groove; the support rod comprises a socket portion, and the socket portion extends out of a bottom opening of the mounting groove for insertion into a ground;

wherein the mounting groove further passes through a top of the parapet body, and a top end of the support rod extends out of a top opening of the mounting groove to form a snap-in structure; the parapet body is arranged with a mating structure, and the snap-in structure is capable of being snap-fit with the mating structure to limit an upward movement of the support rod relative to the parapet body.

2. The parapet according to claim 1, wherein the snap-in structure comprises a connection portion, an elastic arm portion, and a support portion; the connection portion extends in a front-back direction, and an end of the connection portion is connected to the top end of the support rod; the elastic arm portion extends in the up-down direction, and a top end of the elastic arm portion is connected to an end of the connection portion away from the support rod; the support portion is connected to a lower end of the elastic arm portion and extends towards the support rod;

the mating structure comprises a mating protrusion protruding from the parapet body, and an end of the support portion near the support rod is snapped to the mating protrusion upwardly.

3. The parapet according to claim 2, wherein the support portion is inclined downwardly from an end near the elastic arm portion toward an end near the support rod; and/or the snap-in structure further comprises a guide portion, the guide portion extending from top to bottom at an incline in a direction away from the support rod; a top end of the guide portion is connected to an end of the support portion near the support rod; in condition of the snap-in structure being mated with the mating structure from top to bottom, the mating protrusion slides along the guide portion until being snapped with the support portion.

4. The parapet according to claim 1, wherein the socket portion comprises at least two socket sections, the at least two socket sections being arranged along a length direction of the support rod; a limiting step is formed between each adjacent two of the at least two socket sections, and a limiting surface of the limiting step is facing upwards.

5. The parapet according to claim 4, wherein a width of each socket section decreases from top to bottom; and/or, a tip is formed at a bottom end of the socket portion.

6. The parapet according to claim 1, wherein along a length direction of the parapet body, a side of the parapet body defines a connection groove, and an other side of the parapet body is arranged with a connection post, each of the connection groove and the connection post extending in the up-down direction; an upper end or a lower end of the connection groove passes through the parapet body to define an assembly inlet; the connection groove is configured to mate with another connection post of another parapet body through the assembly inlet, and the connection post is configured to mate with another connection groove of another parapet body through another assembly inlet.

7. The parapet according to claim 6, wherein the assembly inlet is disposed at a lower end of the connection groove, and the connection groove is arranged with a limiting portion opposite the assembly inlet at an upper end of the connection groove; the limiting portion is configured to limit the another connection post.

8. The parapet according to claim 1, wherein the parapet body comprises a connection rod and two parapet panels; the mounting groove is defined in the connection rod, and the two parapet panels are connected to opposite sides of the connection rod.

9. The parapet according to claim 8, wherein a size of the connection rod in a front-back direction is greater than a thickness of each parapet panel; and/or a reinforcement bar is arranged protruding from a surface of each parapet panel.

* * * * *